US010168723B2

(12) United States Patent
Kang

(10) Patent No.: US 10,168,723 B2
(45) Date of Patent: Jan. 1, 2019

(54) REFERENCE VOLTAGE GENERATOR BEING TOLERANT OF TEMPERATURE VARIATION

(71) Applicant: SK hynix Inc., Gyeonggi-do (KR)

(72) Inventor: Jin Seong Kang, Seoul (KR)

(73) Assignee: SK Hynix Inc., Gyeonggi-do (KR)

( * ) Notice: Subject to any disclaimer, the term of this patent is extended or adjusted under 35 U.S.C. 154(b) by 120 days.

(21) Appl. No.: 14/702,449

(22) Filed: May 1, 2015

(65) Prior Publication Data

US 2016/0170432 A1 Jun. 16, 2016

(30) Foreign Application Priority Data

Dec. 15, 2014 (KR) ..... 10-2014-0180685

(51) Int. Cl.
*G05F 3/26* (2006.01)
*G05F 3/30* (2006.01)

(52) U.S. Cl.
CPC . *G05F 3/26* (2013.01); *G05F 3/30* (2013.01)

(58) Field of Classification Search
CPC ..... G05F 3/08; G05F 3/10; G05F 3/16; G05F 3/20; G05F 3/30
USPC ..... 323/304, 311–317
See application file for complete search history.

(56) References Cited

U.S. PATENT DOCUMENTS 5,430,395 A 7/1995 Ichimaru
5,451,860 A * 9/1995 Khayat ..... G05F 3/30 323/313
5,570,008 A * 10/1996 Goetz ..... G05F 3/30 323/315
5,696,440 A * 12/1997 Harada ..... G05F 3/262 323/313
5,841,270 A * 11/1998 Do ..... G05F 3/245 323/314
6,046,578 A * 4/2000 Feldtkeller ..... G05F 3/225 323/314
6,201,381 B1 * 3/2001 Yasuda ..... G05F 3/262 323/315
6,292,050 B1 * 9/2001 Dooley ..... G05F 3/245 327/540

(Continued)

FOREIGN PATENT DOCUMENTS

CN 101216717 7/2008
CN 101443721 5/2009

(Continued)

OTHER PUBLICATIONS

Office Action issued by the State Intellectual Property Office dated May 11, 2018.

*Primary Examiner* — Jeffrey Gblende
*Assistant Examiner* — David A. Singh
(74) *Attorney, Agent, or Firm* — IP & T Group LLP

(57) ABSTRACT

A reference voltage generator includes a mirroring circuit generating a first sub-voltage and a second sub-voltage that are constant, a first voltage generator including a first switch generating a first voltage based on the first sub-voltage, and a second voltage generator including a second switch generating a second voltage that is lower than the first voltage based on the second sub-voltage, wherein the second switch has a threshold voltage that is lower than the first switch to keep a voltage difference between the first voltage and the second voltage as a first reference voltage.

16 Claims, 3 Drawing Sheets

(56) References Cited

U.S. PATENT DOCUMENTS

| | | | | |
|---|---|---|---|---|
| 6,791,308 | B2 * | 9/2004 | Shim | G05F 3/245 323/314 |
| 6,831,503 | B2 * | 12/2004 | La Rosa | G05F 3/262 323/315 |
| 7,157,893 | B2 * | 1/2007 | Lee | G05F 3/245 323/314 |
| 2002/0153870 | A1 * | 10/2002 | Lim | G05F 3/247 323/315 |
| 2006/0261863 | A1 * | 11/2006 | Furuichi | G09G 3/3283 327/108 |

FOREIGN PATENT DOCUMENTS

| | | |
|---|---|---|
| KR | 1019960009158 | 3/1996 |
| KR | 1020020072041 | 9/2002 |

* cited by examiner

REFERENCE VOLTAGE GENERATOR BEING TOLERANT OF TEMPERATURE VARIATION

CROSS-REFERENCE TO RELATED APPLICATION

The present application claims priority to Korean patent application number 10-2014-0180685, filed on Dec. 15, 2014, the entire disclosure of which is herein incorporated by reference in its entirety.

BACKGROUND

Field of Invention

Various embodiments of the present invention relate to a reference voltage generator.

Description of Related Art

A reference voltage generator generates a reference voltage. Reference voltage generators are used in both semiconductor devices and semiconductor systems. To generate a constant reference voltage, the reference voltage generator needs to be designed so it is not affected by changes in input power and temperature.

As the integration of semiconductor devices is increased and operations thereof become more complicated, changes in temperature may increase performance degradation of semiconductor devices. For example, when temperature increases, the amount of current flowing through the elements in the semiconductor devices may be reduced, resulting in the operation speed of the semiconductor devices being reduced.

SUMMARY

Various embodiments of the present invention are directed to a reference voltage generator capable of generating a reference voltage that is constant regardless of changes in temperature.

According to an embodiment of the present invention, a reference voltage generator may include a first circuit suitable for generating a first sub-voltage and a second sub-voltage that are constant, and a second circuit keeping a constant voltage difference based on the first and second sub-voltages to output a reference voltage.

According to an embodiment of the present invention, a reference voltage generator may include a mirroring circuit suitable for generating a first sub-voltage and a second sub-voltage that are constant, a first voltage generator suitable for generating a first current based on the first sub-voltage and generating a first voltage based on the first current, and a second voltage generator generating a second current based on the second sub-voltage and a second voltage that is lower than the first voltage based on the second current, wherein the second voltage generator keeps a voltage difference between the first voltage and the second voltage as a reference voltage.

According to an embodiment of the present invention, a reference voltage generator may include a mirroring circuit generating a first sub-voltage and a second sub-voltage that are constant; a first voltage generator suitable for generating a first voltage based on the first sub-voltage; and a second voltage generator suitable for generating a second voltage that is lower than the first voltage based on the second sub-voltage, wherein the second switch has a threshold voltage that is lower than the first switch to keep a voltage difference between the first voltage and the second voltage, and outputs a first reference voltage corresponding to the voltage difference.

DETAILED DESCRIPTION

Figure 1:
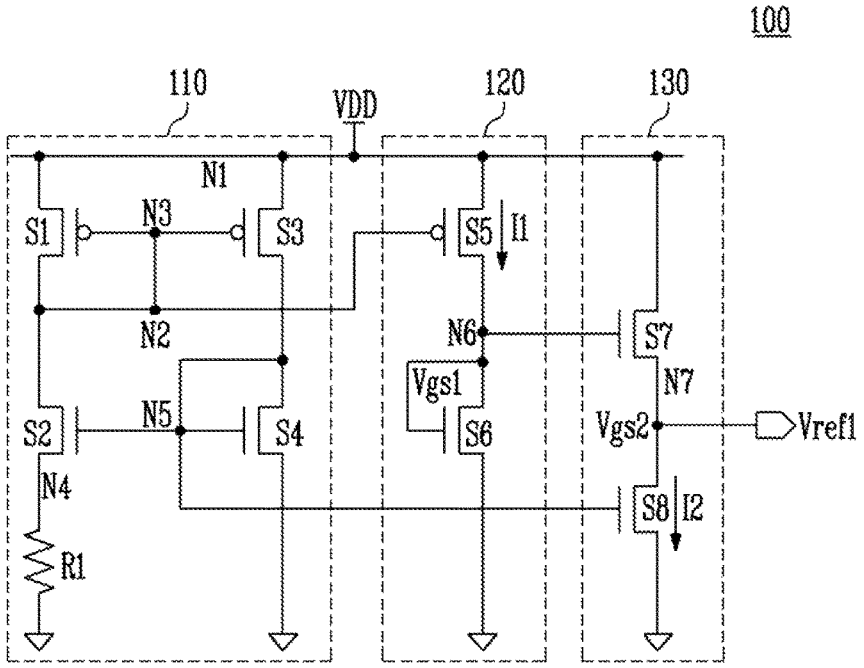
FIG. 1 is a circuit diagram illustrating a reference voltage generator according to an embodiment of the present invention.

Hereinafter, various exemplary embodiments will be described in detail with reference to the accompanying drawings. In the drawings, thicknesses and lengths of components may be exaggerated for convenience of illustration. In the following description, a detailed explanation of related functions and constitutions may be omitted for simplicity and conciseness. Like reference numerals refer to like elements throughout the specification and drawings.

The drawings are not necessarily to scale and, in some instances, proportions may have been exaggerated to clearly illustrate features of the embodiments. It is also noted that in this specification, "connected/coupled" refers to one component not only directly coupling another component, but also indirectly coupling another component through an intermediate component. In addition, a singular form may include a plural form as long as it is not specifically mentioned.

FIG. 1 is a circuit diagram illustrating a reference voltage generator 100 according to an embodiment of the present invention.

Referring to FIG. 1, the reference voltage generator 100 may include a mirroring circuit 110, a first voltage generation circuit 120 and a second voltage generation circuit 130.

The mirroring circuit 110 may be coupled between a first node N1, to which a power voltage VDD is applied, and a ground terminal, and generate a first sub-voltage and a second sub-voltage that are constant. For example, the mirroring circuit 110 may include a first switch S1, a second switch S2, a third switch S3, a fourth switches S4 and a first resistor R1. The first switch S1 may include a PMOS transistor which is coupled between the first node N1 and a second node N2, and controlled by a voltage of a third node N3. Initial values of the second node N2 and the third node N3 may be set low. The second switch S2 may include an NMOS transistor which is coupled between the second node N2 and a fourth node N4, and controlled by a voltage of a fifth node N5. The first resistor R1 may be coupled between the fourth node N4 and the ground terminal. The third switch S3 may include a PMOS transistor which is coupled between the first node N1 and the fifth node N5, and controlled by the voltage of the third node N3. The fourth switch S4 may include an NMOS transistor which is coupled between the fifth node N5 and the ground terminal, and controlled by the voltage of the fifth node N5. The first and third switches S1 and S3 and the second and fourth switches S2 and S4 may be coupled in a mirrored configuration. However, since the first resistor R1 is coupled to the fourth node N4, a voltage difference may occur between the second node N2 and the fifth node N5. A voltage applied to the second node N2 may be defined as the first sub-voltage, and a voltage applied to the fifth node N5 may be referred to as the second sub-voltage. The first and second sub-voltages may be obtained by dividing the power voltage VDD applied to the first node N1.

The first voltage genera on circuit 120 may include a fifth switch S5 and a sixth switch S6. The fifth switch S5 may include a PMOS transistor which is coupled between the first node N1 and a sixth node N6, and is controlled by a voltage of the second node N2. The sixth switch S6 may include an NMOS transistor which is coupled between the sixth node N6 and a ground terminal, and controlled by a voltage of the sixth node N6. A current flowing through the fifth switch S5 by the first sub-voltage may be defined as a first current I1. The voltage of the sixth node N6 caused by the first current I1 may be defined as a first voltage Vgs1.

The second voltage generation circuit 130 may include a seventh switch S7 and an eighth switch S8. The seventh switch S7 may include an NMOS transistor which is coupled between the first node N1 and a seventh node N7, and controlled by the voltage of the sixth node N6. The eighth switch S8 may include an NMOS transistor which is coupled between the seventh node N7 and a ground terminal, and controlled by the voltage of the fifth node N5. A current flowing through the eighth switch S8 by the second sub-voltage may be defined as a second reference current I2. A voltage of the seventh node N7 caused by the second reference current I2 may be defined as a second voltage Vgs2. The seventh node N7 may be an output node of the reference voltage generator 100. In other words, the second voltage Vgs2 may be a first reference voltage Vref1.

To achieve temperature compensation, the sixth switch S6 of the first voltage generation circuit 120 and the seventh switch S7 of the second voltage generation circuit 130 may include NMOS transistors having different threshold voltages. For example, when the sixth switch S6 has a first threshold voltage, the seventh switch S7 may have a second threshold voltage that is lower than the first threshold voltage. The difference in threshold voltage between the switches may be obtained by using various methods. For example, switches may be formed with different sizes, or doping regions may have different impurity concentrations, so that a threshold voltage difference may occur between the switches.

Operations of the reference voltage generator 100 are described below.

Since the third node N3 has a low initial voltage, a constant current may flow through the first and third switches S1 and S3. Therefore, divided voltages of the power voltage VDD may be transferred to the second node N2 and the fifth node N5. Since a lower positive voltage than the power voltage VDD is applied to the fifth node N5, the channel formed in the second and fourth switches S2 and S4 may result in a current path formed through the first node N1, the second node N2, the second switch S2, the fourth node N4, the first resistor R1 and the ground terminal and a current path formed through the first node N1, the third switch S3 the fifth node N5, the fourth switch S4 and the ground terminal. Since the first to fourth switches S1 to S4 are coupled in the current mirror configuration, the first sub-voltage that is constant may be applied to the second node N2, and the second sub-voltage that is constant may be applied to the fifth node N5. Since the channel of the fifth switch S5 remains constant by the first sub-voltage, the first current I1 that is constant may flow through the fifth switch S5. Since the channel of the eighth switch S8 remains constant by the second sub-voltage, the second current I2 that is constant may flow through the eighth switch S8. Since the threshold voltages of the sixth and seventh switches S6 and S7 are different from each other, a difference may occur between the first current I1 and the second current I2. Therefore, a difference may also occur between the first voltage Vgs1 and the second voltage Vgs2. However, since both the sixth and seventh switches S6 and S7 include NMOS transistors, electrical characteristics thereof may change in the same manner in response to changes in temperature. Therefore, the difference between the first voltage Vgs1 and the second voltage Vgs2 may have a constant value. The difference between the first voltage Vgs1 and the second voltage Vgs2 may be the first reference voltage Vref1, which is output through the seventh node N7. Therefore, the first reference voltage Vref1 may have a constant value regardless of changes in temperature.

Figure 2:
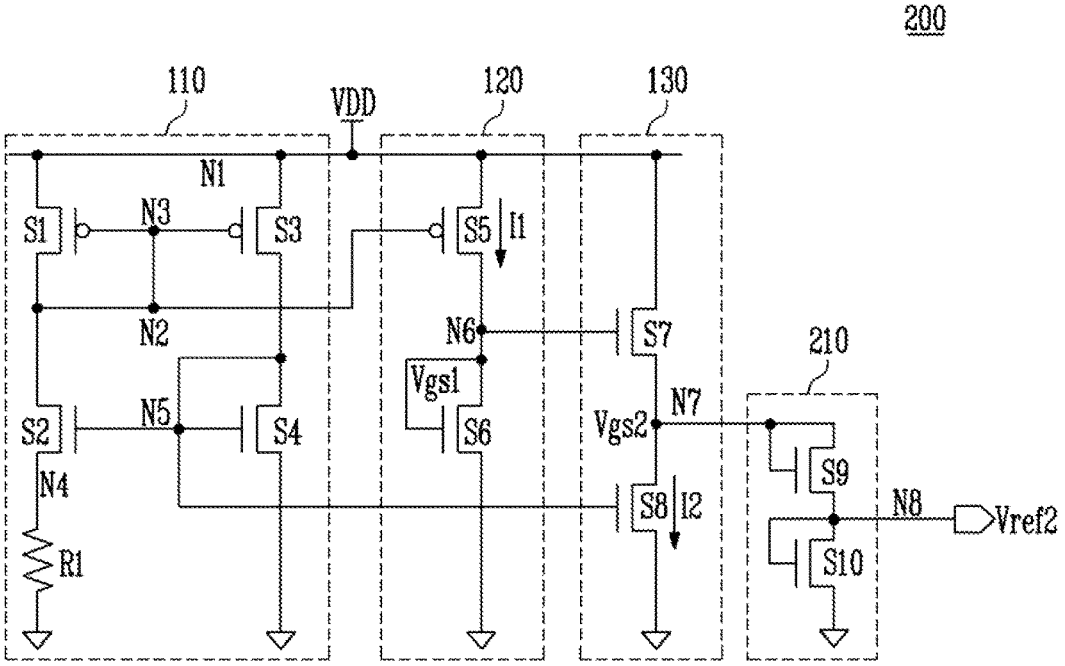
FIG. 2 is a circuit diagram illustrating a reference voltage generator according to an embodiment of the present invention.

FIG. 2 is a circuit diagram illustrating a reference voltage generator 200 according to an embodiment of the present invention.

Referring to FIG. 2, the reference voltage generator 200 may further include a voltage correction circuit 210 that corrects the first reference voltage Vref1 output from the reference voltage generator 100.

The reference voltage generator 200 may include the mirroring circuit 110, the first voltage generation circuit 120, the second voltage generation circuit 130 and the voltage correction circuit 210.

The mirroring circuit 110 may be coupled between the first node N1 to which the power voltage VDD is applied and a ground terminal, and generate a first sub-voltage and a second sub-voltage that are constant. For example, the mirroring circuit 110 may include the first to fourth switches S1 to S4 and the first resistor R1. The first switch S1 may include a PMOS transistor which is coupled between the first node N1 and the second node N2, and controlled by a voltage of the third node N3. Initial values of the second node N2 and the third node N3 may be set low. The second switch S2 may be coupled between the second node N2 and the fourth node N4, and controlled by a voltage of the fifth node N5. The first resistor R1 may include an NMOS transistor which is coupled between the fourth node N4 and the ground terminal. The third switch S3 may include a PMS transistor which is coupled between the first node N1 and the fifth node N5, and controlled by the voltage of the third node N3. The fourth switch S4 may include an NMOS transistor which is coupled between the fifth node N5 and the ground terminal, and controlled by the voltage of the fifth node N5. The first and third switches S1 and S3 and the second and fourth switches S2 and switch S4 may be coupled in a mirrored configuration. However, since the first resistor R1 is coupled to the fourth node N4, a voltage difference may occur between the second node N2 and the fifth node N5. A voltage applied to the second node N2 may be defined as the first sub-voltage, and a voltage applied to the fifth node N5 may be defined as the second sub-voltage. The first and second sub-voltages may be obtained by dividing the power voltage VDD applied to the first node N1.

The first voltage generation circuit 120 may include the fifth switch S5 and the sixth switch S6. The fifth switch S5 may include a PMOS transistor which is coupled between the first node N1 and the sixth node N6, and controlled by a voltage of the second node N2. The sixth switch S6 may include an NMOS transistor which is coupled between the sixth node N6 and the ground terminal, and controlled by a voltage of the sixth node N6. A current flowing through the fifth switch S5 by the first sub-voltage may be defined as the first current I1, and the voltage of the sixth node N6 generated by the first current I1 may be defined as the first voltage Vgs1.

The second voltage generation circuit 130 may include the seventh switch S7 and the eighth switch S8. The seventh switch S7 may include an NMOS transistor which is coupled between the first node N1 and the seventh node N7, and controlled by the voltage of the sixth node N6. The eighth switch S8 may include an NMOS transistor which is coupled between the seventh node N7 and the ground terminal, and controlled by the voltage of the fifth node N5. A current flowing through the eighth switch S8 by the second sub-voltage may be defined as the second reference current I2. A voltage of the seventh node N7 generated by the second reference current I2 may be defined as the second voltage Vgs2. The seventh node N7 may be an output node of the reference voltage generator 100. In other words, the second voltage Vgs2 may be the first reference voltage Vref1.

To achieve temperature compensation, the sixth switch S6 of the first voltage generation circuit 120 and the seventh switch S7 of the second voltage generation circuit 130 may include NMOS transistors having different threshold voltages. For example, when the sixth switch S6 has a first threshold voltage, the seventh switch S7 may have a second threshold voltage that is lower than the first threshold voltage. The difference in threshold voltage between the switches may be obtained by various methods. For example, switches may be formed with different sizes, or doped regions may have different impurity concentrations, so that a threshold voltage difference may occur between the switches.

When the threshold voltages of the sixth and seventh switches S6 and S7 are different from each other, a difference may occur between the currents flowing through the sixth node N6 and the seventh node N7. As a result, a difference may occur between the first voltage Vgs1 and the second voltage Vgs2. Since the sixth and seventh switches S6 and S7 include NMOS transistors, electrical characteristics thereof may equally change (i.e. change in a uniform or substantially similar manner) according to changes in temperature. Thus, the difference between the first voltage Vgs1 and the second voltage Vgs2 may have a constant value. Since the difference between the first voltage Vgs1 and the second voltage Vgs2 may be the first reference voltage Vref1 which is output through the seventh node N7, the first reference voltage Vref1 may have a constant value regardless of changes in temperature.

The voltage correction circuit 210 may include a ninth switch S9 and a tenth switch S10. The ninth switch S9 may include an NMOS transistor which is coupled between the seventh node N7 and an eighth node N8, and controlled by the voltage of the seventh node N7, i.e., the first reference voltage Vref1. The tenth switch S10 may include an NMOS transistor which is coupled between the eighth node N8 and a ground terminal, and controlled by a voltage of the eighth node N8. The ninth and tenth switches S9 and S10 may include NMOS transistors having substantially the same electrical characteristics. A voltage divided by the ninth and tenth switches S9 and S10 may be applied to the eighth node N8 and be a second reference voltage Vref2. In other words, when a constant first reference voltage Vref1 is output, regardless of changes in temperature, the voltage correction circuit 210 may divide the first reference voltage Vref1 to generate the second reference voltage Vref2, which is lower than the first reference voltage Vref1, and has a constant voltage.

Figure 3:
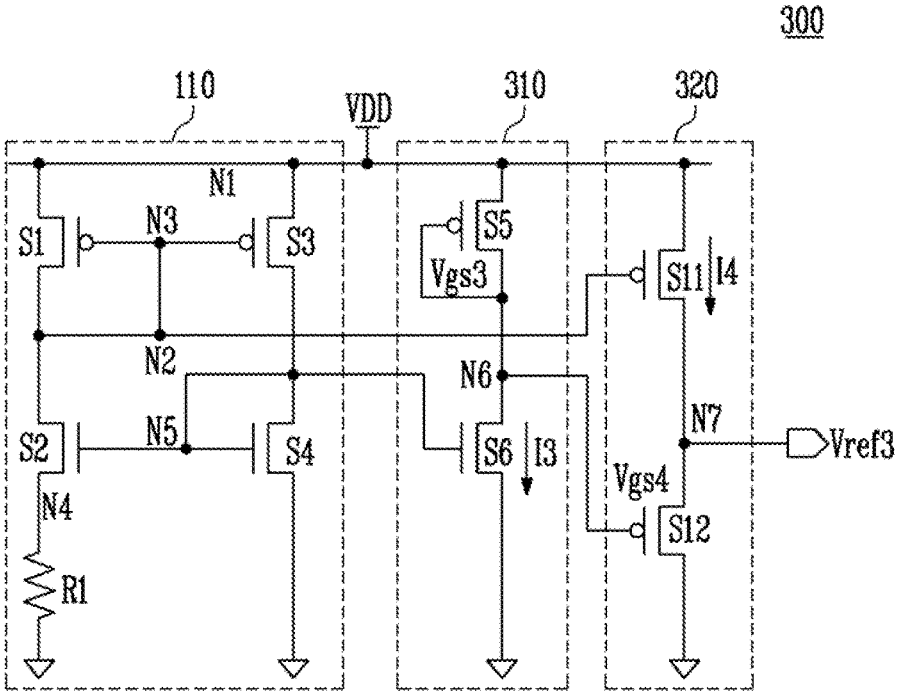
FIG. 3 is a circuit diagram illustrating a reference voltage generator according to an embodiment of the present invention.

FIG. 3 is a circuit diagram illustrating a reference voltage generator 300 according to an embodiment of the present invention.

Referring to FIG. 3, the reference voltage generator 300 may include the mirroring circuit 110, a third voltage generation circuit 310 and a fourth voltage generation unit 320.

The mirroring circuit 110 may be coupled between the first node N1 to which the power voltage VDD is applied and a ground terminal, and generate a first sub-voltage and a second sub-voltage that are constant. For example, the mirroring circuit 110 may include the first to fourth switches S1 to S4 and the first resistor R1. The first switch S1 may include a PMOS transistor which is coupled between the first node N1 and the second node N2, and controlled by a voltage of the third node N3. Initial values of the second node N2 and the third node N3 may be set low. The second switch S2 may include an NMOS transistor which is coupled between the second node N2 and the fourth node N4, and controlled by a voltage of the fifth node N5. The first resistor R1 may be coupled between the fourth node N4 and the ground terminal. The third switch S3 may include a PMOS transistor that is coupled between the first node N1 and the fifth node N5 and controlled by the voltage of the third node N3. The fourth switch S4 may include an NMOS transistor that is coupled between the fifth node N5 and the ground terminal and controlled by the voltage of the fifth node N5. The first and third switch S1 and S3 and the second and fourth switches S2 and S4 may be coupled in a mirrored configuration. However, since the first resistor R1 is coupled to the fourth node N4, a difference may occur between the second node N2 and the fifth node N5. A voltage applied to the second node N2 may be defined as the first sub-voltage, and a voltage applied to the fifth node N5 may be defined as the second sub-voltage. The first and second sub-voltages may be obtained by dividing the power voltage VDD, which is applied to the first node N1.

The third voltage generation circuit 316 may include the fifth switch S5 and the sixth switch S6. The fifth switch S5 may include a PMOS transistor which is coupled between the first node N1 and the sixth node N6, and controlled by a voltage of the sixth node N6. The sixth switch S6 may include an NMOS transistor which is coupled between the sixth node N6 and the ground terminal, and controlled by a third current I3. A current flowing through the sixth switch S6 may be defined as the third current I3, and a voltage of the sixth node N6 may be defined as a third voltage Vgs3.

The fourth voltage generation unit 320 may include an eleventh switch S11 and a twelfth switch S12. The eleventh switch S11 may include a PMOS transistor which is coupled between the first node N1 and the seventh node N7, and controlled by a fourth current I4. The twelfth switch S12 may include a PMOS transistor which is coupled between the seventh node N7 and a ground terminal, and controlled by the third voltage Vgs3. A current flowing through the eleventh switch S11 may be defined as the fourth current I4. A voltage of the seventh node N7 may be defined as a fourth voltage Vgs4. The seventh node N7 may be an output node of the reference voltage generator 300. In other words, the fourth voltage. Vgs4 may be a third reference voltage Vref3.

To achieve temperature compensation, the fifth switch S5 of the third voltage generation circuit 310 and the twelfth switch S12 of the fourth voltage generation unit 320 may include PMOS transistors having different threshold voltages. For example, when the fifth switch S5 has a third threshold voltage, the twelfth switch S12 may have a fourth threshold voltage that is lower than the third threshold voltage. The difference in threshold voltage between the switches may be obtained by various methods. For example, switches may be formed with different sizes, or doped regions may have different impurity concentrations, so that a threshold voltage difference may occur between the switches.

When the threshold voltages of the fifth and twelfth switches S5 and S12 are different from each other, a difference may occur between the third reference current I3 and the fourth reference current I4. As a result, a difference may occur between the second voltage Vgs2 and the fourth voltage Vgs4. Since the fifth and twelfth switches S5 and S12 include PMOS transistors, electrical characteristics thereof may change equally according to changes in temperature. Therefore, the difference between the third voltage Vgs3 and the fourth voltage Vgs4 may remain constant. The difference between the third voltage Vgs3 and the fourth voltage Vgs4 may be the third reference voltage Vref3, which is output through the seventh node N7. Therefore, the third reference voltage Vref3 may have a constant value regardless of changes in temperature.

Though not illustrated in FIG. 3, the reference voltage may be controlled by coupling the voltage correction circuit 210 shown in FIG. 2 to the seventh node N7 of the reference voltage generator 300.

Figure 4:
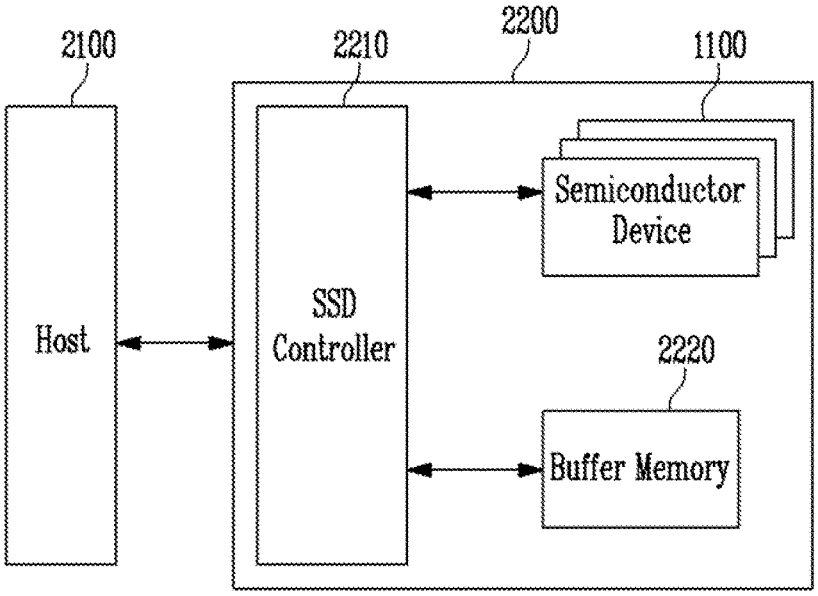
FIG. 4 is a block diagram illustrating a memory system according to an embodiment of the present invention.

FIG. 4 is a block diagram illustrating a memory system 2000 according to an embodiment of the present invention.

Referring to FIG. 4, the memory system 2000 may include a host 2100 and a solid-state drive (SSD) 2200. The SSD 2200 may include an SSD controller 2210, a buffer memory 2220 and a plurality of semiconductor memory devices 1100*s*. The components of the memory system 2000 may be driven by a reference voltage generated by the reference voltage generator according to the embodiments of the present invention.

The SSD controller 2210 may provide a physical connection between the host 2100 and the SSD 2200. In other words, the SSD controller 2210 may perform interfacing with the SSD 2200 according to a bus format of the host 2100. The SSD controller 2210 may decode a command provided from the host 2100. According to the decoding result, the SSD controller 2210 may access the semiconductor memory devices 1100*s*. As the bus format of the host 2100, universal serial bus (USB), small computer system interface (SCSI), peripheral component interconnect express (PCI-E) advanced technology attachment (ATA), parallel ATA (DATA), serial ATA (SATA), and serial attached SCSI (SAS) may be included.

The buffer memory 2220 may temporarily store program data provided from the host 2100 or data read from the semiconductor memory devices 1100*s*. When a read request is made by the host 2100, if data read from the semiconductor memory devices 1100*s* is cached, the buffer memory 2220 may support a cache function to directly provide the cached data to the host 2100. In general, a data transfer speed by the bus format (for example, SATA or SAS) of the host 2100 may be higher than a transfer speed of a memory channel of the SSD 2200. In other words, when an interface speed of the host 2100 is higher than the transfer speed of the memory channel of the SSD 2200, performance degradation caused by the speed difference may be minimized by providing buffer memory 2220 having a large capacity. The buffer memory 2220 may be provided as synchronous DRAM to provide sufficient buffering in the SSD 2200.

The semiconductor memory devices 1100*s* may be provided as a storage medium of the SSD 2200. For example, each of the semiconductor memory devices 1100*s* may be provided as a nonvolatile memory device having large storage capacity. Each of the semiconductor memory devices 1100*s* may be provided as a NAND-type flash memory.

Figure 5:
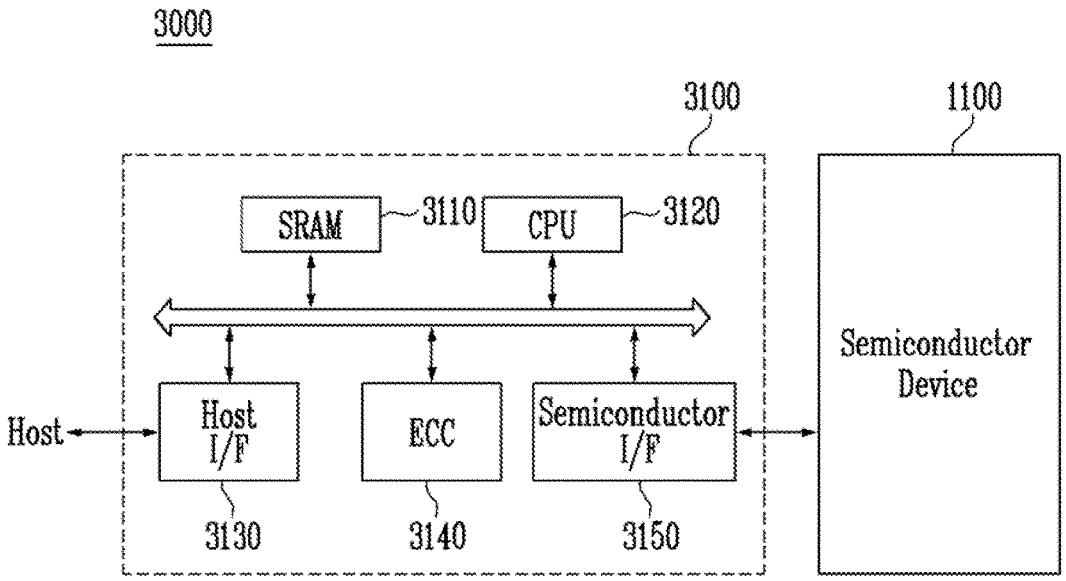
FIG. 5 is a block diagram illustrating a memory system according to an embodiment of the present invention.

FIG. 5 is a block diagram illustrating a memory system 3000 according to an embodiment of the present invention.

Referring to FIG. 5, the memory system 3000 may include a memory control unit 3100 and the semiconductor memory device 1100. The components of the memory system 3000 may be driven by a reference voltage generated by the reference voltage generator according to the embodiments of the present invention.

The semiconductor memory device 1100 may be provided as a storage medium of the memory system 3000.

The memory control unit 3100 may control the semiconductor memory device 1100. The memory control unit 3100 may include a static random access memory (SRAM) 3110, a central process unit (CPU) 3120, a host interface (I/F) 3130, an error correction circuit (ECC) 3140, and a semiconductor I/F 3150. The SRAM 3110 may be used as a working memory of the CPU 3120. The host interface (I/F) 3130 may include a data exchange protocol of a host electrically coupled with the memory system 3000. The error correction circuit (ECC) 3140 may detect and correct errors in data read from the semiconductor memory device 1100. The semiconductor I/F 3150 may interface with the semiconductor memory device 1100. The CPU 3120 may perform a control operation for data exchange of the memory control unit 3100. In addition, although not illustrated in FIG. 5, a read only memory (ROM) (not shown) for storing code data for interfacing with a host may be provided in the memory system 3000.

The memory system 3000 may be applied to one of a computer, an ultra mobile PC (UMPC), a workstation, a net-book, a PDA, a portable computer, a web tablet, a wireless phone, a mobile phone, a smartphone, a digital camera, a digital audio recorder, a digital audio player, a digital picture recorder, a digital picture player, a digital video recorder, a digital video player, a device of transmitting and receiving information in a wireless environment, and various devices constituting a home network.

Figure 6:
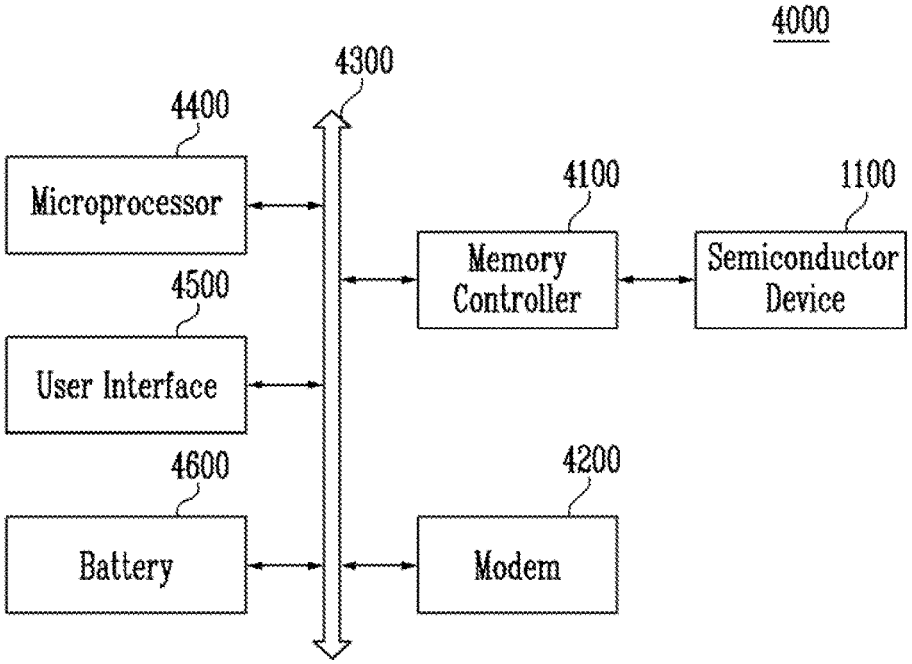
FIG. 6 is a diagram illustrating a computing system according to an embodiment of the present invention.

FIG. 6 is a block diagram illustrating a computing system 4000 according to an embodiment of the present invention.

Referring to FIG. 6, the computing system 4000 may include the semiconductor memory device 1100, a memory controller 4100, a modem 4200, a microprocessor 4400, and a user interface 4500 which are electrically coupled to a bus 4300. When the computing system 4000 is a mobile device, a battery 4600 for supplying an operation voltage of the computing system 4000 may be additionally provided. The computing system 4000 may include an application chip set (not shown), a camera image processor (not shown), a mobile DRAM (not shown), and the like.

The semiconductor memory device 1100 may be provided as a storage medium of the computing system 4000.

The memory controller 4100 and the semiconductor memory device 1100 may be components of an SSD.

The semiconductor memory device 1100 and the memory controller 4100 may be mounted using various types of packages. For example, the semiconductor memory device 1100 and the memory controller 4100 may be mounted using packages such as package on package (PoP), ball grid arrays (BGAs), chip scale packages (CSPs), plastic leaded chip carrier (PICC), plastic dual in-line package (PDIP), die in waffle pack, die in wafer form, chip on board (COB), ceramic dual in-line package (CERDIP), plastic metric quad flat pack (MQFP), thin quad flat pack (TQFP), small outline integrated circuit (SOIC), shrink small outline package (SSOP), thin small outline package (TSOP), system in package (SIP), multi chip package (MCP), wafer-level fabricated package (WFP), wafer-level processed stack package (WSP), and the like.

According to an embodiment of the present invention, a constant reference voltage may be generated regardless of changes in temperature, so that semiconductor device performance degradation that uses a reference voltage generator may be prevented.

It will be apparent to those skilled in the art that various modifications can be made to the above-described exemplary embodiments of the present invention without departing from the spirit or scope of the invention. Thus, it is intended that the present invention cover all such modifications provided they come within the scope of the appended claims and their equivalents.

What is claimed is:

1. A reference voltage generator, comprising: a first circuit configured to generate a first sub-voltage and a second sub-voltage that are constant; and a second circuit keeping a constant voltage difference based on the first and second sub-voltages to output a reference voltage corresponding to the constant voltage difference, wherein the second circuit comprises: a first voltage generator including a first switch, and generating a first voltage based on the first sub-voltage and a threshold voltage of the first switch; and a second voltage generator including a second switch configured to control an amount of current of a power voltage applied to an output node in response to the first voltage, and forming a current path from the output node to a ground terminal based on the second sub-voltage, wherein the second switch has a threshold voltage that is lower than the threshold voltage of the first switch to keep a voltage difference between the first voltage and the second voltage, and outputs a first reference voltage corresponding to the voltage difference.

2. The reference voltage generator of claim 1, wherein the first circuit comprises a mirroring circuit.

3. A reference voltage generator, comprising: a mirroring circuit configured to generate a first sub-voltage and a second sub-voltage that are constant; a first voltage generator including a first switch, and coupled between a node, to which a power voltage is applied, and a ground terminal, and configured to generate a first current based on the first sub-voltage, and generate a first voltage based on the first current; and a second voltage generator including a second switch, and configured to generate a second current based on the second sub-voltage and the first voltage, and generate a second voltage that is lower than the first voltage based on the second current, wherein the second switch has a threshold voltage that is lower than the threshold voltage of the first switch to keep a voltage difference between the first voltage and the second voltage, and outputs a first reference voltage corresponding to the voltage difference.

4. The reference voltage generator of claim 3, wherein the first voltage generator generates the first voltage, which is temperature dependent, and the second voltage generator generates the second voltage, which is temperature dependent.

5. The reference voltage generator of claim 4, wherein the voltage difference between the first voltage and the second voltage remains constant regardless of changes in temperature.

6. A reference voltage generator, comprising: a mirroring circuit generating a first sub-voltage and a second sub-voltage that are constant; a first voltage generator coupled between a node, to which a power voltage is applied, and a ground terminal, and including a first switch configured to generate a first voltage based on the first sub-voltage; and a second voltage generator including a fourth switch configured to generate a second voltage that is lower than the first voltage based on the second sub-voltage and the first voltage, wherein a second switch has a threshold voltage that is lower than a threshold voltage of the first switch to keep a voltage difference between the first voltage and the second voltage, and outputs a first reference voltage corresponding to the voltage difference.

7. The reference voltage generator of claim 6, wherein the mirroring circuit includes switches coupled between a terminal to which the power voltage is applied and the ground terminal, and generates the first and second sub-voltages by forming a constant current path.

8. The reference voltage generator of claim 6, wherein the first voltage generator includes the first switch and a second switch coupled in series between a terminal to which the power voltage is applied and the ground terminal, wherein the first and second switches generate the first voltage, and the second voltage generator includes the third switch and the fourth switch coupled in series between the terminal to which the power voltage is applied and the ground terminal, wherein the third and fourth switches generate the second voltage.

9. The reference voltage generator of claim 8, wherein the second and third switches are substantially similar.

10. The reference voltage generator of claim 8, wherein electrical characteristics of the second and third switches change equally according to changes in temperature.

11. The reference voltage generator of claim 8, wherein the first switch includes a PMOS transistor controlled by the first sub-voltage to transfer the power voltage to the second switch, and the second switch includes an NMOS transistor generating the first voltage based on a voltage transferred from the first switch.

12. The reference voltage generator of claim 11, wherein the third switch includes an NMOS transistor controlled by the first voltage to transfer the power voltage to the fourth switch, and the fourth switch includes an NMOS transistor, generating the second voltage based on the second sub-voltage.

13. The reference voltage generator of claim 8, wherein the first switch includes a PMOS transistor controlled by the first sub-voltage to transfer the power voltage to the second switch, and the second switch includes an NMOS transistor controlling the first voltage based on the second sub-voltage.

14. The reference voltage generator of claim 13, wherein the third switch includes a PMOS transistor controlled by the first sub-voltage to transfer the power voltage to the fourth switch, and the fourth switch includes a PMOS transistor controlling the second voltage based on the first voltage.

15. The reference voltage generator of claim 6, further comprising a voltage correction circuit coupled to the second voltage generator and controlling the first reference voltage to output a second reference voltage.

16. The reference voltage generator of claim 15, wherein the voltage correction circuit outputs the second reference voltage by dividing the first reference voltage.

* * * * *